US005927018A

United States Patent [19]

Thain

[11] Patent Number: 5,927,018

[45] Date of Patent: Jul. 27, 1999

[54] DEVICE FOR OPENING AND CLOSING A SLIDING DOOR

[76] Inventor: Colin A. Thain, 63 Centre Street, Beeton, Ontario, Canada, L0G 1A0

[21] Appl. No.: 09/004,852

[22] Filed: Jan. 9, 1998

[51] Int. Cl.[6] ..... E05B 1/00

[52] U.S. Cl. ..... 49/460; 16/86 R

[58] Field of Search ..... 49/460, 404; 16/110 R, 16/124, 82, 86 R, 86 A

[56] References Cited

U.S. PATENT DOCUMENTS

| | | | |
|---|---|---|---|
| D. 294,003 | 2/1988 | Simoncelli . | |
| 3,240,259 | 3/1966 | Kelleher et al. | 49/460 X |
| 3,280,422 | 10/1966 | Hoffmann | 16/86 R |
| 4,208,841 | 6/1980 | Starks | 49/449 |
| 4,893,435 | 1/1990 | Shalit . | |

FOREIGN PATENT DOCUMENTS

| | | | |
|---|---|---|---|
| 48008 | 8/1980 | Switzerland | 16/86 R |

*Primary Examiner*—Jerry Redman
*Attorney, Agent, or Firm*—Barrigar & Moss

[57] ABSTRACT

A hands-free door opening device for attachment to a sliding door so that the sliding door can be opened or closed by a person using his or her foot. The device has a base section having a surface adapted for placement against the sliding door, securing means for rigidly securing the base section to a lower portion of the sliding door, and a rigid forwardly extending section connected to and extending from the base section in a direction away from the placement surface. The forwardly extending section extends a distance sufficient to allow a person's foot to engage the extending section to slide the door when the device is secured to the door. The device can be secured to the sliding door with double sided tape, or with screws, or with both.

5 Claims, 2 Drawing Sheets

DEVICE FOR OPENING AND CLOSING A SLIDING DOOR

BACKGROUND OF INVENTION

The present invention relates to a device for opening and closing a sliding door, and in particular a device which provides for hands-free opening and closing of horizontally sliding doors.

Many homes today are equipped with sliding door units such as patio doors which allow access in and out of the home to a recreation area or an outside barbecue area such as a deck, patio, yard, balcony, etc. Such door units typically include one or more sliding glass doors which consist of framed glass panels mounted for sliding horizontal movement. Often, such door units also include a sliding screen door similarly mounted for sliding horizontal movement along guide tracks.

As patio doors typically lead to a recreation area or an outside cooking area, they can at times be a relatively high volume point of entry and exit to a home. Despite the high volume, it is often desirable to maintain sliding patio doors in a closed position to the greatest extent possible in order to prevent hot or cold outside air from entering the home, or to keep out noise or insects, and for other reasons.

Most sliding doors include a handle which a person must push or pull with his or her hand to open and close the door. Such handles are typically located approximately three feet from the bottom of the door, and accordingly a person must have a free hand to open or close the door. This can be inconvenient as people often have their hands full of things such as cooking utensils, table settings, trays or plates of food, cases of bottled beverages, or recreational equipment and the like when they are attempting to pass through patio doors, and are thus unable to open the sliding door in a conventional manner. In such situations, people either have to put down some of the objects that they are carrying, or ask for assistance, or perhaps struggle to open and then subsequently close the door with a stray finger or elbow. People will sometimes also try to use a foot to open or close a sliding patio door. However, this requires the person to push his or her foot hard against the door in a direction transverse to its path of travel to get enough friction between their foot and the door to subsequently push the door along its track. In some cases, the necessary degree of friction may be very difficult or impossible to obtain, and the person's foot will simply slip along the door with no result.

In commercial locations, sliding doors will often be electrically activated by an electric eye or infrared detector in order to permit hands-free operation. However, such a solution is quite expensive and goes beyond the needs of most residential settings.

Accordingly, it would be desirable to provide an inexpensive device which would allow a sliding door to be easily opened or closed without requiring a person to use their hands. It would also be desirable to have such a device which could be easily and securely attached to existing sliding patio doors. It would also be convenient to provide a sliding door unit having a sliding door which could be opened and closed in a hands-free manner.

SUMMARY OF THE INVENTION

The present invention provides a hands-free door opening device which can be attached to a sliding door so that a person can open and close the sliding door with his or her foot.

According to one aspect of the invention, there is provided a hands-free door opening device for attachment to a sliding door mounted for sliding movement so that the door can be slid between open and closed positions by applying force on the device with a person's foot in the direction of the door's travel. The device includes first and second elongate kick plate portions for engagement by a person's foot. The kick plate portions each have a first end and a second end, the first ends of the kick plate portions being connected together and the second ends of the kick plate portions being spaced apart from each other. The device also includes first and second base members each having a planar surface, the first base member being attached to the second end of the first kick plate portion and the second base member being attached to the second end of the second kick plate portion, the planar surfaces of the base members being located in a common plane. Securing means are provided for securing the base members to a lower portion of the sliding door with the planar surfaces facing the sliding door.

The securing means can include double sided tape affixed to each of the planar surfaces, or the securing means may include a hole provided through each of the base members and screws for inserting through the holes and into the lower portion of the sliding door. Preferably, the kick plate portions form a V-shape in plan view. Furthermore, each kick plate portion is preferably inwardly arcuate in plan view such that each kick plate portion has a concave outer surface for engagement by a person's foot. The base members and kick plates can be formed from a unitary piece of rigid material selected from the group consisting of vinyl, plastic, foam, and metal.

According to a further aspect of the invention, there is provided a device for attachment to a lower portion of a sliding door mounted for sliding movement to allow the door to be opened by a person's foot. The device comprises a rigid base section having a surface adapted for placement against the sliding door, means for rigidly securing the base section to a lower portion of the sliding door with the placement surface facing the sliding door, and a forwardly extending section connected to and extending forwardly from the base section in a direction away from the placement surface a distance sufficient to allow a person's foot to engage the forwardly extending section to slide the door when the base section is secured to the door.

Preferably, the securing means includes a strip of double sided tape, one side of which is secured to the placement surface and the opposite side of which can be secured to the sliding door. Alternatively, or in addition to double sided tape, the securing means can include a screw for securing the base section to a lower portion of the sliding door, the base section having a hole passing therethrough for receiving the shaft or shank of the screw. Preferably, the forwardly extending section has a V-shape in plan view.

According to still a further aspect of the invention, there is provided a door unit comprising upper and lower track members, a sliding door having a barrier member framed within a rectangular frame having upper, lower, and two side framing members extending around the peripheral edges of the barrier member, the sliding door being mounted for sliding movement along a path of travel defined by the track members, and a hands-free opening device secured to the lower framing member, the device having a forwardly extending portion which extends forwardly from the lower framing member such that the sliding door can be slid along its path of travel by a person engaging the forwardly extending portion with his foot.

DESCRIPTION OF THE PREFERRED EMBODIMENTS

Figure 1:
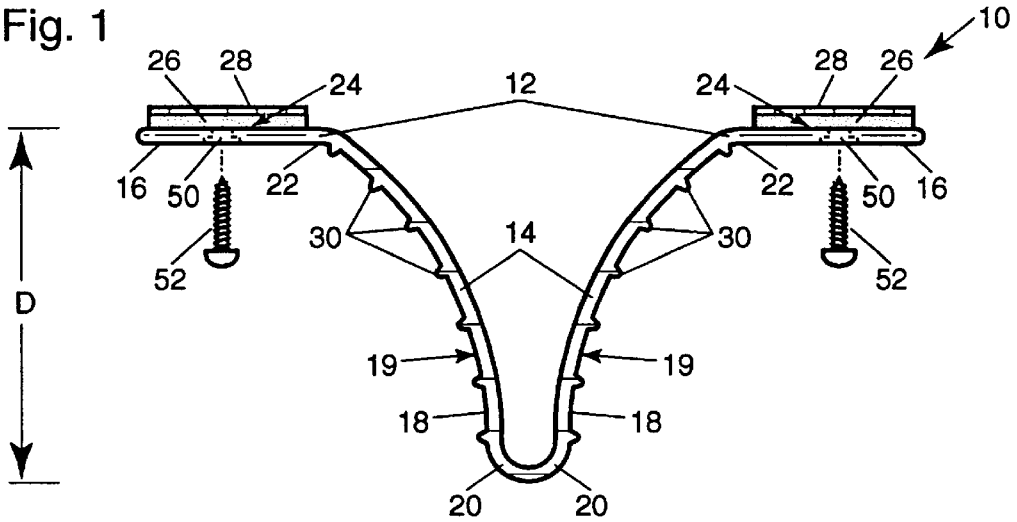
FIG. 1, in a plan view, illustrates a hands-free sliding door opening and closing device in accordance with a preferred embodiment of the present invention.
Figure 2:
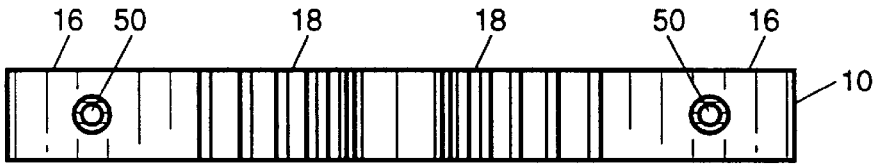
FIG. 2 shows a front end view of the device of FIG. 1.

FIGS. 1 and 2 illustrate a hands-free sliding door opening device, indicated generally by 10, in accordance with one preferred embodiment of the invention. The device 10 includes a base section 12 and a forwardly extending section 14, and is preferably formed from a unitary piece of rigid material. As will be explained in greater detail below, the base section 12 is used to secure the device 10 to a sliding patio door so the forwardly extending section 14 can be engaged with a person's foot to open and close the sliding door. In the first preferred embodiment of the invention, the base section 12 includes two rigid substantially rectangular base members 16, and the forwardly extending section 14 includes two kick plate portions 18. The kick plate portions 18 are each formed from elongate substantially rectangular strips of rigid material having a substantially uniform thickness, and each kick plate portion 18 has a first end 20 and a second end 22. The first ends 20 are rigidly attached together such that the two kick plate portions form a "V"-shape in plan view, with the second ends 22 of the kick plates 18 being spaced apart from each other. Preferably, the kick plate portions 18 each have an inwardly arcuate shape in plan view, thus providing each of the kick plates with a concave outer surface 19. One of the base members 16 extends outwardly from the second end 22 of one of the kick plates 18, and the other base member 16 extends outwardly in an opposite direction from the second end 22 of the other kick plate 18. The base members 16 each include a vertically extending planar surface 24 which acts as an interface between the device 10 and the sliding door to which it is secured. The planar surfaces 24 are each located in a common vertical plane. In one preferred embodiment, the device 10 is formed from extruded vinyl and the base members 16 and kick plates 18 have a substantially uniform thickness and height along the length of the device 10.

Preferably, a rectangular piece of double sided tape 26 is secured to each of the planar surfaces 24 to permit the device 10 to be attached to a sliding door. Until the device 10 is actually secured to the sliding door, the side of the tape not secured to the planar surfaces 24 is covered with a removable backing material 28. One suitable double sided tape is 3M (Trade-mark) VHB double coated multi-weather adhesive acrylic foam tape.

As best seen in FIG. 1, the kick plates 18 each preferably include a number of spaced, vertically extending V-shaped bumps or ribs 30 on their respective outer concave surfaces 19. The ribs 30 are provided to increase the friction that exists between a person's foot and the kick plates 18 when a person's foot comes in contact with the kick plates.

Figure 3:
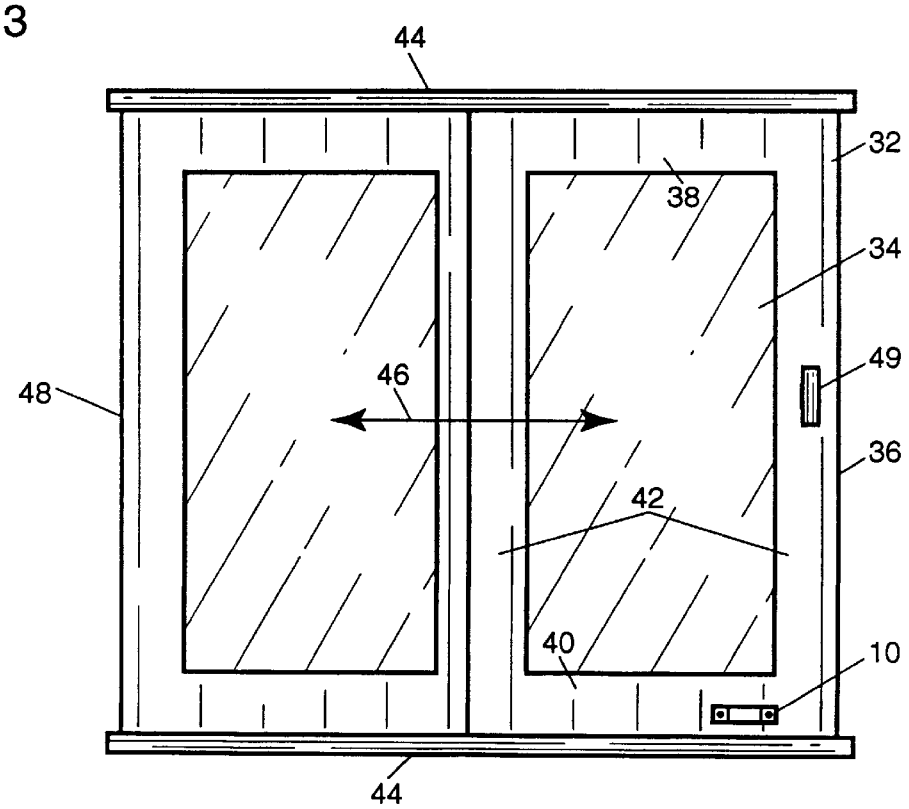
FIG. 3 shows a front elevation showing the device of FIG. 1 secured to a conventional sliding door.

With reference to FIGS. 1 to 3, the operation of the hands-free door opening device 10 will now be described in greater detail. FIG. 3 shows a conventional sliding patio door 32, which includes a barrier member 34 supported by a rectangular frame 36 having an upper 38, lower 40, and side 42 framing members. The barrier member 34 may be a pane (or panes) of glass, or a screen, or other types of barrier materials. The upper and lower frame members 38 and 40 will typically have rollers (not shown) affixed to them which are received within elongate guide tracks 44, which permit the sliding door 32 to slide horizontally between open and closed positions along a path of travel indicated by the arrow 46. Typically, sliding door 32 will slide adjacent to a fixed door 48 when placed in its open position (the door 32 is shown in its closed position in FIG. 3). A handle 49 is included on one of the side frame members 42 and can be gripped with a hand to open and close the door 32. Typically, the handle 49 will include some form of releasable locking mechanism for locking the door 32 in its closed position. The present invention is intended for use when such a locking mechanism is not engaged.

The device 10 is easily attached to the installed sliding door 32 simply by removing the backing material 28 from the double sided tape pieces 26 and pressing the planar surfaces 24 of the base members 16 against the lower frame member 40. FIG. 3 illustrates the preferred position of the device 10 on the sliding patio door once it has been attached thereto. Preferably, the device 10 be installed so that its lowest point is not more than 5 inches above the lower track member 44.

Once the device 10 has been installed on the sliding door 32, a person can easily open and close an unlocked door by engaging one of the kick plate portions 18 (in particular, the kick plate portion that is facing away from the desired direction of travel of the door) with his or her foot and applying a force on the device 10 in the intended direction of travel of the door 32. This force will be transferred through the device 10 to the door 32, which will slide along its tracks 44 to the desired position. Accordingly, the device 10 provides for hands-free operation of the door 32. If desired, a second device 10 can be attached to the other side of the door 32 (not shown) to permit the hands-free operation of the door from both inside and outside locations. Additionally, a device 10 can also be secured to one or both sides of multiple sliding doors (such as a screen door and a glass pane door) that are mounted parallel to each other to provide for hands-free operation of each door.

The shape of the device 10 as shown in FIG. 1 provides numerous advantages in that the base section 12 and the forwardly extending section 14 can easily be formed as a rigid, unitary structure from a number of different materials using different manufacturing techniques. By way of example, the base section 12 and extending section 14 can be formed by vinyl extrusion (as mentioned above), by injection molding suitable plastic or foam materials, or by extrusion of aluminum or other suitable metals.

The V-shaped configuration of the kick plates 18 provides a strong structure that can withstand a great deal of applied force on the kick plates 18 without breaking, which allows the device 10 to be constructed with a minimal amount of material. The arcuate shape of the kick plate portions 18 also contributes to the overall strength of the device 10, and additionally the concave shape of the surfaces 19, together with ribs 30, provide a good interface between the device 10 and a person's foot in order to prevent the person's foot from slipping along the device 10.

In one preferred embodiment, the device 10 is configured so that it will extend outwardly from the door 32 a distance (shown by D in FIG. 1) of approximately 1.2 inches. Such a distance is sufficient to allow a person to easily engage the device 10 with his or her foot, while at the same time not making the device 10 overly obtrusive. However, it will be appreciated that the device 10 could be configured to extend a distance D that is greater or less than 1.2 inches and still function satisfactorily.

Although the double-sided tape 26 will generally provide sufficient means for securing the device 10 to a sliding door, in some situations it may be desirable to use additional or alternative means to secure the device 10 to a sliding door 32. Accordingly, the device 10 can optionally include a hole 50 through each of the base members 16 so that screws 52 can be used in addition to, or instead of, tape 26 to secure the device 10 to the door 32. Screws 52 are preferably conventional flat head screws, and holes 50 are preferably countersunk so that the heads of screws 52 will be flush with the outer surface of the device 10 once installed. In the event that the screws 52 are used to secure the device 10 to the sliding door, it may be necessary to provide pilot holes in the lower member 40 for the screws 52 (depending on the material that the member 40 is constructed from). When screws are used to secure the device 10, it will be appreciated that the device 10 need not include double sided tape 26, and accordingly the device 10 could be sold having holes 50, but not tape 26, or with tape 26 but no holes 50, or, for maximum diversity, with both holes 50 and tape 26. If both screws 52 and tape 26 were used to secure the device 10, the tape 26 could be used to position and secure the device 10 to the door 32, after which one can easily install screws 52 to further secure the device 10 without requiring the installer to hold onto the device 10 while screwing in the screws 52. In certain applications, it may be desirable to use nails instead of screws to secure the device 10. Additionally, suitable two way adhesives other than the tape disclosed above could be used if desired. It will thus be appreciated that the device 10 can easily be installed on existing sliding doors.

Figure 4:
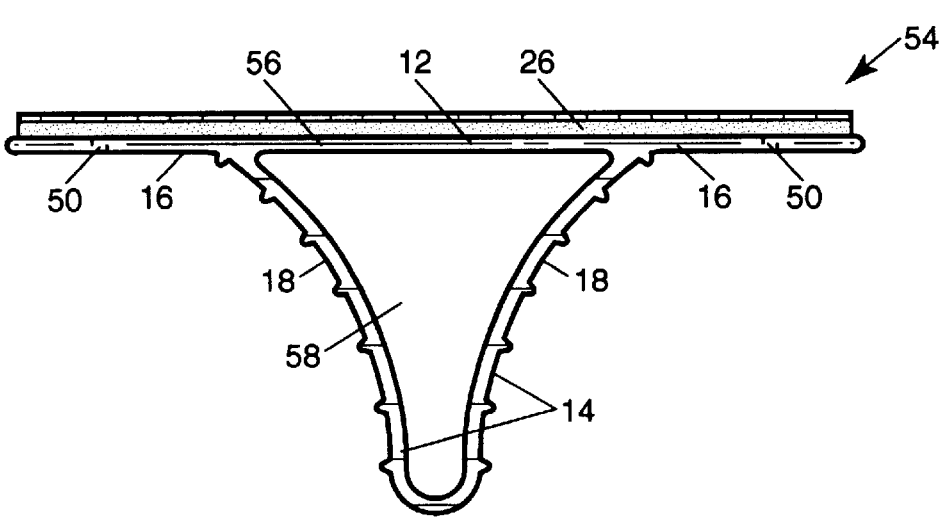
FIG. 4 shows a plan view of a hands-free door opening device in accordance with a further preferred embodiment of the present invention.

It will be understood that the door opening device of the present invention could take a number of different configurations. For example, FIG. 4 illustrates a door opening device 54 that is similar to device 10 except for the difference as noted below. The door opening device 54 includes an additional support member 56 which extends between the two base members 16 such that the base section 12 of the device 54 is a single continuous section comprising base members 16 and support member 12. A single strip of double sided tape 26 extends along the entire length of the base section 12 for securing the device 54 to sliding door. Holes 50 may be provided through the base members 16 for accepting screws.

As illustrated in FIG. 4, a hollow hole or cavity 58 is provided between the kick plate portions 18 and support member 56. However, the device 56 can be formed such that this cavity 58 is replaced with a solid mass, in which case the forwardly extending section 14 would be a single block of material having two concave surfaces.

Figure 5:
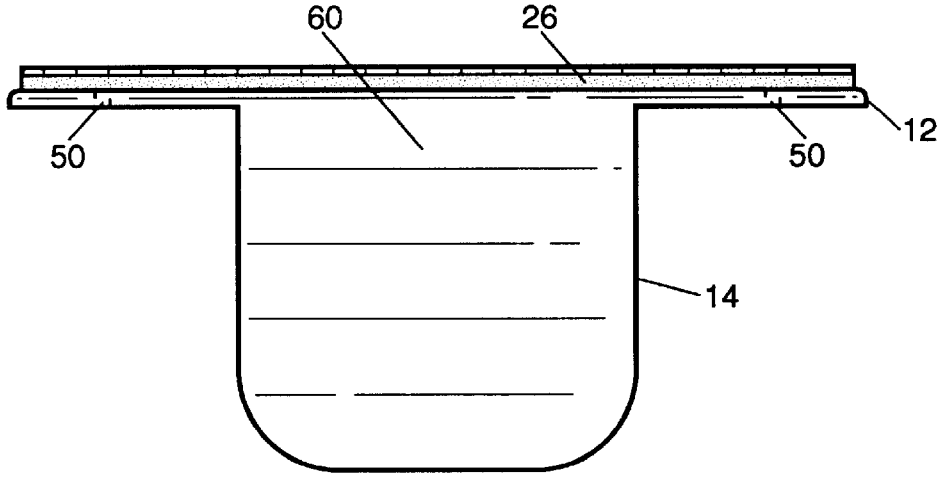
FIG. 5 shows a plan view of a hands-free door opening device in accordance with a third preferred embodiment of the present invention.
Figure 6:
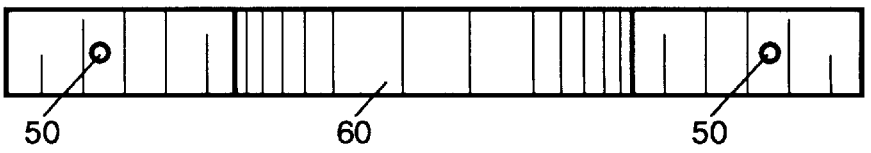
FIG. 6 shows a front end view of the device of FIG. 5.

The device of the present invention could also be constructed without concave sides. In this regard, FIGS. 5 and 6 illustrate a further hands-free door opening device 60 in which the forwardly extending portion 14 is a unitary rectangular block which extends from base section 12. The device 60 could be constructed from materials such as wood, in addition to vinyl, plastic or metal.

In addition to being retrofitted to existing sliding doors, the device for opening and closing sliding doors of the present invention could also be included as part of an originally manufactured sliding door. In this regard, a sliding door such as that shown in FIG. 3 and described above could be constructed having a device which extended from its lower frame member 40. In such a door, the device could be integrally formed as part of the lower frame member 40. Such a device would be similar to the devices described above, however, if it were formed as an integral part of the lower frame member of the door, it need not include double sided adhesive or screws to secure it to the sliding door. Typically, the lower frame member of a sliding door is made from metal (such as aluminum), fiberglass, vinyl, wood, or combinations of these materials, and it will be appreciated that the door opening and closing device of the present invention could be provided on the lower frame member as it was being manufactured using commonly known manufactured techniques.

As will be apparent to those skilled in the art in the light of the foregoing disclosure, many alterations and modifications are possible in the practice of this invention without departing from the spirit or scope thereof. Accordingly, all such alterations and modifications as fall within the scope of the following claims are intended to be part of this invention.

I claim:

1. A hands free door opening and closing device for attachment to a lower portion of a sliding patio door mounted for sliding horizontal movement to allow the door to be opened and closed by a person's foot when force is applied on the device in a desired direction of movement, comprising:

two base members each having a rearwardly facing planar surface for placement against a surface of the door;

securing means for rigidly securing said base members to the door, including double sided tape for securing the planar surface of each of said base members to the surface of the door; and a rigid forwardly extending section having two kick plates for engagement by a foot, said kick plates each having a first end and a second end, the first ends of said kick plats being connected together, to second end of one of said kick plates being connected to one of said base members, and the end of the other of said kick plates being connected to the other of said base members, said kick plates being arranged in a V-shaped configuration with said connected first ends of said kick plates extending in a forward direction away from the planar surface of said base members, said kick plates each having a generally inwardly arcuate shape such that they each provide a concave outer surface for engagement by the foot, wherein when the device is attached to the door, the foot can engage one of said kick plates to move the door in one direction, and the other of said kick plates to move the door in an opposite direction.

2. A door opening and closing device according to claim 1 wherein said kick plates and said base members are each substantially rectangular in shape, all have a substantially uniform thickness, and are formed together as a rigid unitary vinyl structure.

3. A door and closing device according to claim 1 wherein said kick plates each have a plurality of adjacent ribs located on said outer surface for preventing slippage of a foot when the foot engages the kick plate.

4. A door and closing device according to claim 1 wherein said securing means further includes a hole provided through each of the base members for receiving screws therethrough.

5. A hands free door opening and closing device for attachment to a lower portion of a sliding patio door mounted for sliding horizontal movement to allow the door to be opened and closed by a foot when force is applied to the device in a desired direction of movement, comprising:

a base section having a rearwardly facing planar surface for placement against a surface of the sliding door;

seeing means for rigidly base section to a lower portion of the sliding door with said planar surface facing the sliding door, said securing means including a strip of double sided tape, one side of which is secured to said planar surface and the opposite side of which can be secured to the sliding door; and a rigid forwardly extending section having two kick plates for engagement by the foot, said kick plates each having a fast end and a second end, the first ends of said kick plates being connected together, and the second ends of said kick plates being spaced-apart and connected to said base section, said kick plates being arranged in a V-shaped configuration with said connected ends of said kick plates extending in a forwardly direction away from the planar surface of the base section, said kick plates each having a generally inwardly arcuate shape such that they each provide a concave outer surface for engagement by the foot, wherein when the device is attached to the door, the foot can engage one of said kick plates to move the door in one direction, and the other of said kick plates to move the door in an opposite direction.

* * * * *